US010952282B2

(12) United States Patent
Ghannam et al.

(10) Patent No.: US 10,952,282 B2
(45) Date of Patent: Mar. 16, 2021

(54) VEHICLE SENSOR COLD MITIGATION

(71) Applicant: Ford Global Technologies, LLC, Dearborn, MI (US)

(72) Inventors: Mahmoud Yousef Ghannam, Canton, MI (US); Aed M. Dudar, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 482 days.

(21) Appl. No.: 15/166,942

(22) Filed: May 27, 2016

(65) Prior Publication Data

US 2017/0347395 A1 Nov. 30, 2017

(51) Int. Cl.
*H05B 3/14* (2006.01)
*H05B 1/02* (2006.01)
*H05B 3/00* (2006.01)

(52) U.S. Cl.
CPC ..... *H05B 1/0236* (2013.01); *H05B 1/0202* (2013.01); *H05B 3/0014* (2013.01)

(58) Field of Classification Search
CPC ... H05B 1/0202; H05B 1/0236; H05B 3/0014
USPC ..... 219/200, 203, 202, 208, 209, 205, 206, 219/207
See application file for complete search history.

(56) References Cited

U.S. PATENT DOCUMENTS 4,702,619 A * 10/1987 Camp ..... G01K 7/22 116/303
6,282,969 B1 * 9/2001 Daniel ..... G01S 15/04 367/93
6,710,302 B1 * 3/2004 Rennick ..... G01S 15/04 219/202
7,166,819 B2 * 1/2007 Winter ..... B60S 1/0848 219/202
7,783,400 B1 * 8/2010 Zimler ..... B60S 1/0866 219/202
8,014,930 B2 * 9/2011 Anilovich ..... F01N 11/007 701/102
8,170,772 B2 * 5/2012 Nagashima ..... F02D 41/064 123/179.5
8,671,504 B2 3/2014 Ono et al.
8,823,400 B2 * 9/2014 Hocken ..... F02D 41/1466 324/691
9,702,315 B1 * 7/2017 Palmer ..... F02D 43/00
9,809,085 B1 * 11/2017 Pierce ..... B60H 1/00742
2011/0010035 A1 * 1/2011 Weber ..... F02D 41/26 701/31.4

(Continued)

FOREIGN PATENT DOCUMENTS

DE 19850639 A1 5/1999
DE 102012015260 A1 2/2013

(Continued)

*Primary Examiner* — Robert J Utama
*Assistant Examiner* — Ayub A Maye
(74) *Attorney, Agent, or Firm* — Frank A. MacKenzie; Bejin Bieneman PLC

(57) ABSTRACT

A cold vehicle sensor condition can be determined, and the sensor associated with one or more heat source subsystems that provide a heat byproduct during normal operation of the subsystem. At least some of the heat byproduct can be diverted to heat the sensor. The heat source subsystem selected can be based on a proximity to the associated sensor.

20 Claims, 5 Drawing Sheets

(56) References Cited

U.S. PATENT DOCUMENTS

| | | | | |
|---|---|---|---|---|
| 2011/0073142 | A1* | 3/2011 | Hattori | B60S 1/0848 134/56 R |
| 2012/0244994 | A1* | 9/2012 | Spix | F02D 31/001 477/115 |
| 2014/0104426 | A1 | 4/2014 | Boegel et al. | |
| 2015/0019107 | A1* | 1/2015 | Whitehead | F02D 41/04 701/102 |
| 2016/0176384 | A1* | 6/2016 | Dissette | B60S 1/52 134/34 |
| 2016/0223658 | A1* | 8/2016 | Hallek | G01S 7/52006 |
| 2018/0179940 | A1* | 6/2018 | Hall | F01N 3/2066 |

FOREIGN PATENT DOCUMENTS

| | | | |
|---|---|---|---|
| DE | 102013007560 | A1 | 12/2013 |
| EP | 2829442 | A2 | 1/2015 |

* cited by examiner

VEHICLE SENSOR COLD MITIGATION

BACKGROUND

Increasing complexity of vehicle systems has resulted in a proliferation of various types of vehicle sensors. Further, sensors can be mounted or fixed to various locations throughout the vehicle. Vehicle systems can rely on sensors to provide accurate measurements under a wide variety of environmental conditions in which the sensors are exposed. For example, sensors mounted to the exterior of the vehicle are exposed to conditions such as ice and snow, as well as extreme cold temperatures, and sometimes are expected to operate under these cold conditions.

DETAILED DESCRIPTION

Introduction

Figure 1:
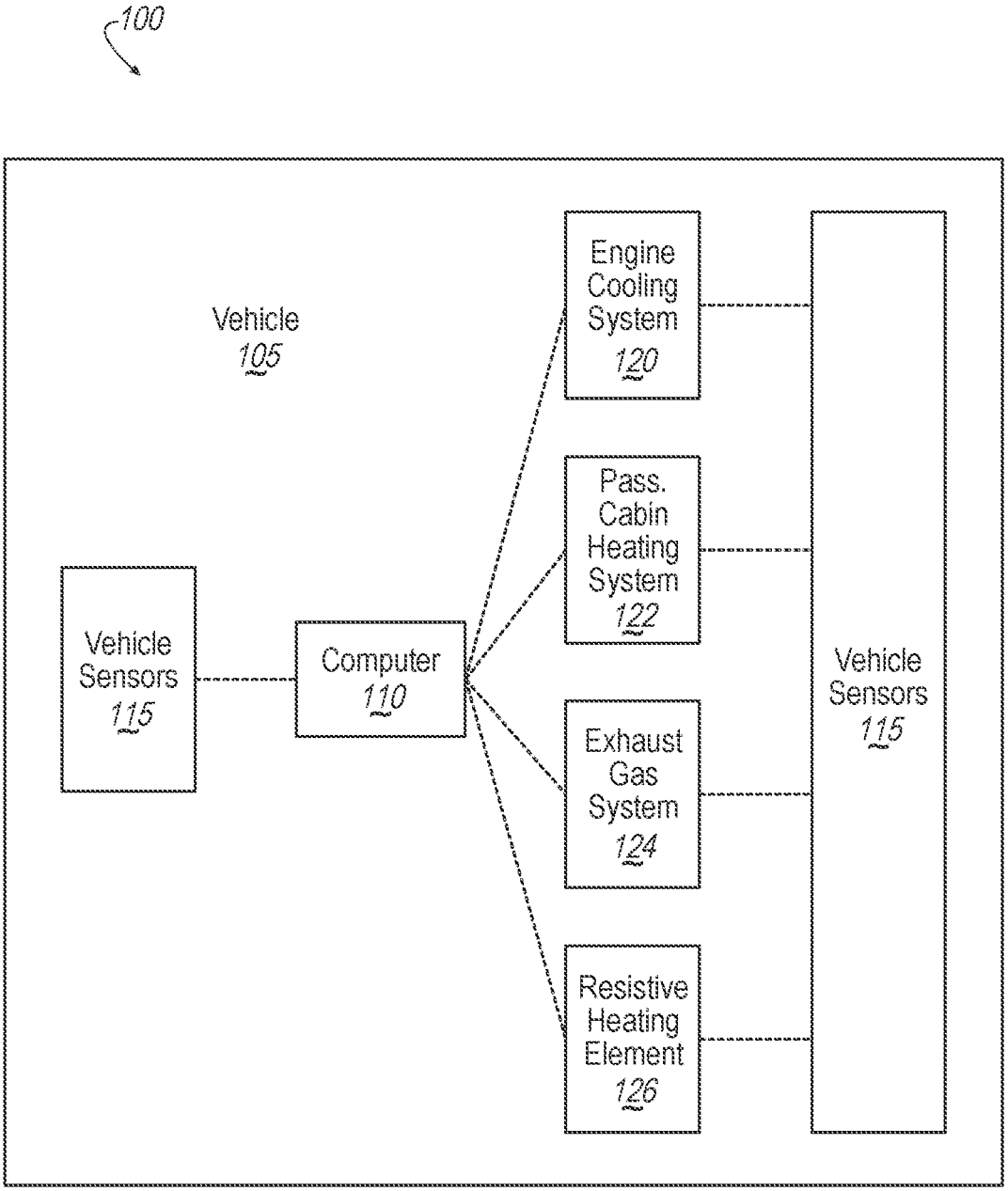
FIG. 1 is a block diagram of an example vehicle sensor cold mitigation system.

Referring to FIG. 1, an ice prevention and removal system 100 as disclosed herein may be deployed and used in a vehicle 105 (sometimes referred to as the "host" vehicle), and is well-suited for vehicles 105 having sensing systems that may be exposed to cold weather environmental elements such as ice and/or snow. The host vehicle 105 typically includes sensors 115 mounted to the vehicle 105, e.g., exterior to a heated vehicle cabin, and whose exposure to cold weather elements may impair sensor 115 operation, e.g., accuracy of measurements, ability to transmit sensed data, etc. Heat from host vehicle 105 heat sources, i.e., existing vehicle 105 subsystems, can be diverted to address cold conditions. For example, the heat sources can include an engine cooling subsystem 120, a passenger cabin heating subsystem 122, and an exhaust gas subsystem 124. During normal and routine operation, these subsystems 120, 122, 124 provide heat as a byproduct. For example, an engine cooling subsystem 120 normally operates to remove heat from an engine and/or engine compartment, an exhaust subsystem 124 emits hot exhaust gases, etc. Such heat sources can be used to provide heat to mitigate and/or prevent ice formation on sensors 115, remove existing ice and/or snow from the sensors 115, e.g., de-ice at vehicle 105 start-up or during operation, and/or to warm sensors 115 in low temperature conditions, etc. In addition, a resistive heating element 126 can be provided to supplement the heat sourced from subsystems 120, 122, 124, e.g., by providing heat to sensors 115 before a vehicle 105 is in an engine-running state.

The host vehicle 105 includes a computer 110 in communication with the vehicle sensors 115. The vehicle sensors 115 can be exterior to a vehicle cabin as mentioned above, but also can be interior to the vehicle cabin and/or in a location where, at least during vehicle 105 operation, the sensor 115 is not likely to be subjected to cold, e.g., in an engine compartment. The sensors 115 as is known can monitor statuses of various vehicle components and/or environmental conditions in and around the vehicle 105. The computer 110 is programmed to determine, based on sensor 115 data, whether cold conditions, e.g., potential icing conditions are present and warrant cold mitigation actions. For example, the computer 110 may selectively actuate direction of heat from one or more host vehicle 105 heat sources to prevent ice formation on, and/or de-ice existing ice from, one or more sensors 115 identified as at risk from cold conditions. As described in additional detail below, various heat sources are located throughout the vehicle 105. Actuation of a specific heat source could depend upon the proximity to the critical sensor 115. Directing heat from a heat source proximate to a sensor 115 can advantageously reduce heat loss by extraneous tube/duct lengths and heat transport delays, and can advantageously utilize heat energy that is a byproduct of operating the vehicle 105 and one or more subsystems 120, 122, 124 in a normal and usual fashion to mitigate cold risk to sensors 115.

Exemplary System Elements

As illustrated in FIG. 1, the host vehicle 105 includes an exemplary system 100 for cold mitigation, e.g., preventing and/or removing ice formation on vehicle components such as sensors 115. The exemplary system 100 includes sensors 115, including sensors essential to vehicle operations such as navigation, guidance, etc., that are mounted to the vehicle 105 and sensitive to cold environmental elements such as ice or snow. Further, the system 100 includes a computer 110 programmed to receive data from sensors 115 to determine icing conditions by taking into account data received from the vehicle sensors 115. Yet further, the system 100 includes various vehicle 105 subsystems that are heat sources, e.g., an engine cooling subsystem 120, a passenger cabin heating subsystem 122, and an engine exhaust gas subsystem 124, at various locations in the vehicle 105. Such heat sources can be selectively utilized to provide heat to one or more sensors 115. For example, as described herein, when icing conditions are present, the computer 110 may activate a heat source closest to a sensor 115 to warm the sensor 115. Supplemental heat sources, e.g., resistive heating elements 126, may in some situations be used to augment heat provided by the heat source subsystems 120, 122, 124, and/or heat the sensor 115 when a host vehicle 105 engine 155 is not running.

Certain sensors 115, as explained above, provide measurements for vehicle 105 subsystems, and may be sensitive, i.e., fall outside of design tolerances, when exposed to ice and/or snow accumulations and/or well as extremely cold temperatures, e.g., below zero degrees Celsius. Although vehicle 105 subsystems may be designed to allow for reduced performance when a sensor 115 providing data to the subsystem is exposed to such environmental conditions, some vital subsystems, e.g., vehicle navigation, lane-keeping, adaptive cruise control, obstacle detection, etc., may not tolerate reduced performance. Accordingly, one or more sensors 115 can advantageously be heated to remedy or prevent degraded operation from potential or actual cold conditions, e.g., ice and/or snow accumulation, while the vehicle 105 is in operation and/or upon or in advance of vehicle 105 startup. Vehicle 105 subsystems protected by heating of sensors 115 may include, for example, adaptive cruise control, emergency brake assist, lane-departure warning, pedestrian detection, blind-spot detection, odometry, global positioning system (GPS), real-time 3D obstacle mapping, etc. Sensors 115 for which heating is provided can include, for example, one or more lidar sensors, radar sensors, ultrasonic sensors, cameras, infrared sensors, etc.

A vehicle sensor 115 can provide data to the computer 110 via a wired or wireless connection, e.g., controller area network (CAN) bus, local interconnect network (LIN), BLUETOOTH®, etc. One or more sensors 115 may be mounted in any suitable location on an external surface 130 of the vehicle 105; many mechanisms for locating and mounting sensors on a vehicle are known. For example, a sensor 115 may be mounted directly to a front bumper 135 and/or a rear bumper 140 (see FIGS. 2 and 4). Alternatively or additionally, the sensor 115 may be coupled to the external surface 130 via a bracket 145 mounted directly to the vehicle 105 (see FIG. 3). Such an exterior sensor 115 typically includes a plurality of components, e.g., housing, transceiver, antenna, lens, mechanical rotating elements, etc. A sensor 115 may include electrical and/or mechanical components such as are known to accept inputs, e.g., radio frequency (RF) energy, light energy, etc., and to provide output, e.g., electrical signals that can be received by the computer 110. One or more of sensor 115 components can be susceptible to cold weather conditions, e.g., can accumulate environmental elements such as ice and/or snow, thereby degrading or even disabling the sensor 115 performance.

Alternatively or additionally, a sensor 115 could be sensitive to extremely low temperatures, e.g., below zero Celsius, −30° Celsius, etc. For example, the sensor 115 may be shielded from the environmental elements by a weatherproof cover, shield, etc., but nonetheless exposed to an ambient temperature.

The host vehicle 105 is generally a land-based vehicle having three or more wheels, e.g., a passenger car, light truck, etc. The vehicle 105 computer 110 generally includes a processor and a memory, the memory including one or more forms of computer-readable media, and storing instructions executable by the processor for performing various operations, including as disclosed herein. Further, the computer 110 may include and/or be communicatively coupled to more than one computing device, e.g., controllers or the like included in the vehicle 105 for monitoring and/or controlling various vehicle components, e.g., an engine control unit (ECU), heating, ventilation and air conditioning (HVAC) control unit, body control module (BCM), etc.

The computer 110 is generally configured, i.e., could include hardware and/or software, for communications on a vehicle 105 network such as a CAN bus, LIN bus or the like. Via the CAN bus, LIN bus, and/or other wired or wireless mechanisms, the computer 110 may transmit messages to various devices in a vehicle and/or receive messages from the various devices, e.g., controllers, actuators, sensors 115, etc. Alternatively or additionally, in cases where the computer 110 actually comprises multiple devices, the CAN bus or the like may be used for communications between devices represented as the computer 110 in this disclosure. In addition, the computer 110 may be configured for communicating with other devices via various wired and/or wireless networking technologies, e.g., cellular, Bluetooth, Wi-Fi, a universal serial bus (USB), wired and/or wireless packet networks, etc.

The memory of the computer 110 generally stores collected data. Collected data may include a variety of data collected in the vehicle 105. Examples of collected data may include measurements relating to a position, velocity, and size (e.g., length, width, height, radar cross section) of target(s) such as moving and/or stationary objects near the vehicle 105. Additionally, collected data may include data calculated therefrom in the computer 110 as well as data received from the sensors 115. In general, collected data may include any data that may be gathered by sensors 115 and/or computed from such data.

The memory of the computer 110 may store data, e.g., in a lookup table or the like, that associates a vehicle sensor 115 to a heat source subsystem 120, 122, 124 location value (e.g., "front," "middle," "rear," respectively). For example, a specific sensor 115 mounted on the front bumper 135 of the vehicle 105 may have a unique identifier value, e.g., "01," "02," etc., and can thereby be associated in a table or other data structure with the heat source subsystem 120 location value "front." In the case of resistive heating elements 126, which can be placed at many locations in the host vehicle 105 including on the sensor 115 itself, the computer 110 memory may store data, e.g., in a lookup table or the like, that associates a vehicle sensor 115 to a specific resistive heating element 126 value (e.g., "A," "B," etc.). For example, a specific sensor 115 mounted on the rear bumper 140 of the vehicle 105 may have a unique identifier value, e.g., "01," "02," etc., and can be associated with the specific resistive heating element 126 value. Due to the location of the sensors 115 and heating elements 126, there may be two or more resistive elements 126 that heat one specific sensor 115 and/or one heating element 126 that heats two or more sensors 115. In this case, the computer 110 memory may store this data in a similar fashion as above by associating two or more heating elements 126 with one sensor 115, and/or one heating element 126 with two or more sensors 115, respectively.

The vehicle sensors 115 include sensors that can provide collected data to the computer 110 to identify cold weather conditions, e.g., icing conditions, extremely low temperature conditions, etc. For example, icing conditions include environmental conditions favorable for ice and/or snow formation on a sensor 115, as well as conditions where accumulated ice and/or snow currently exists on the critical sensors 115. Furthermore, data from vehicle sensors 115, e.g., internal cabin temperature sensors, outside air temperature (OAT) sensors, etc., may be used by the computer 110 to monitor ambient temperatures to determine extremely low temperature conditions. The vehicle sensors 115 may include one or more sensors 115 known for sensing environmental conditions, e.g., rain sensors, thermistors, humidity sensors, vehicle speed sensors, etc.

The vehicle 105 computer 110 can further use data from a remote computer or the like to identify cold weather conditions than may degrade or disable a sensor 115. Such data could include a barometric pressure, wind speed, freezing temperature and/or freezing rain forecast, etc., for a geographic area in which the vehicle 105 is located. Further for example, the computer 110 could utilize the GPS location data correlated with weather forecast and data from the onboard vehicle sensors 115 to assist in determining icing conditions.

Figure 2:
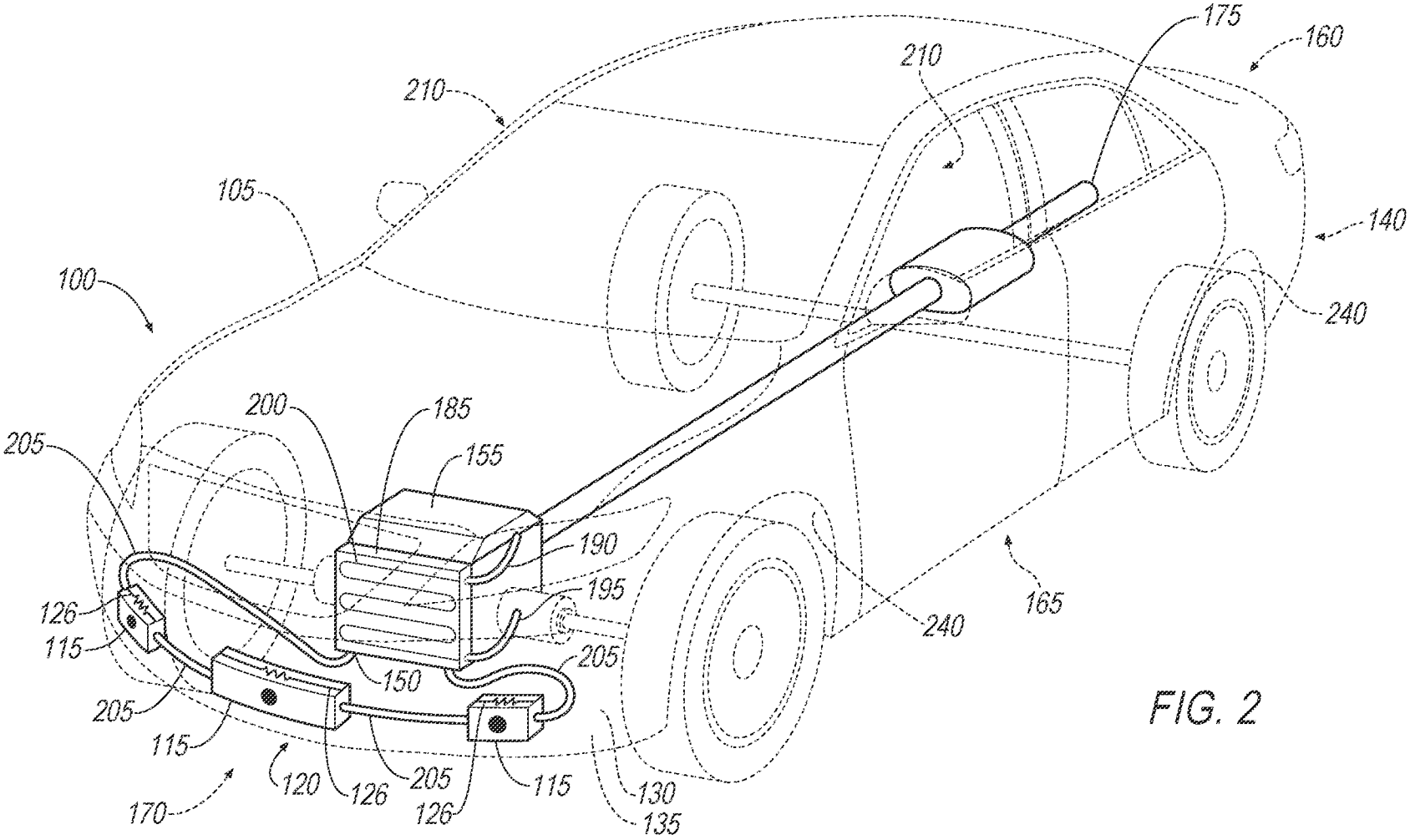
FIG. 2 is a perspective view of a host vehicle including an engine cooling subsystem that diverts a heat byproduct to vehicle sensors.
Figure 3:
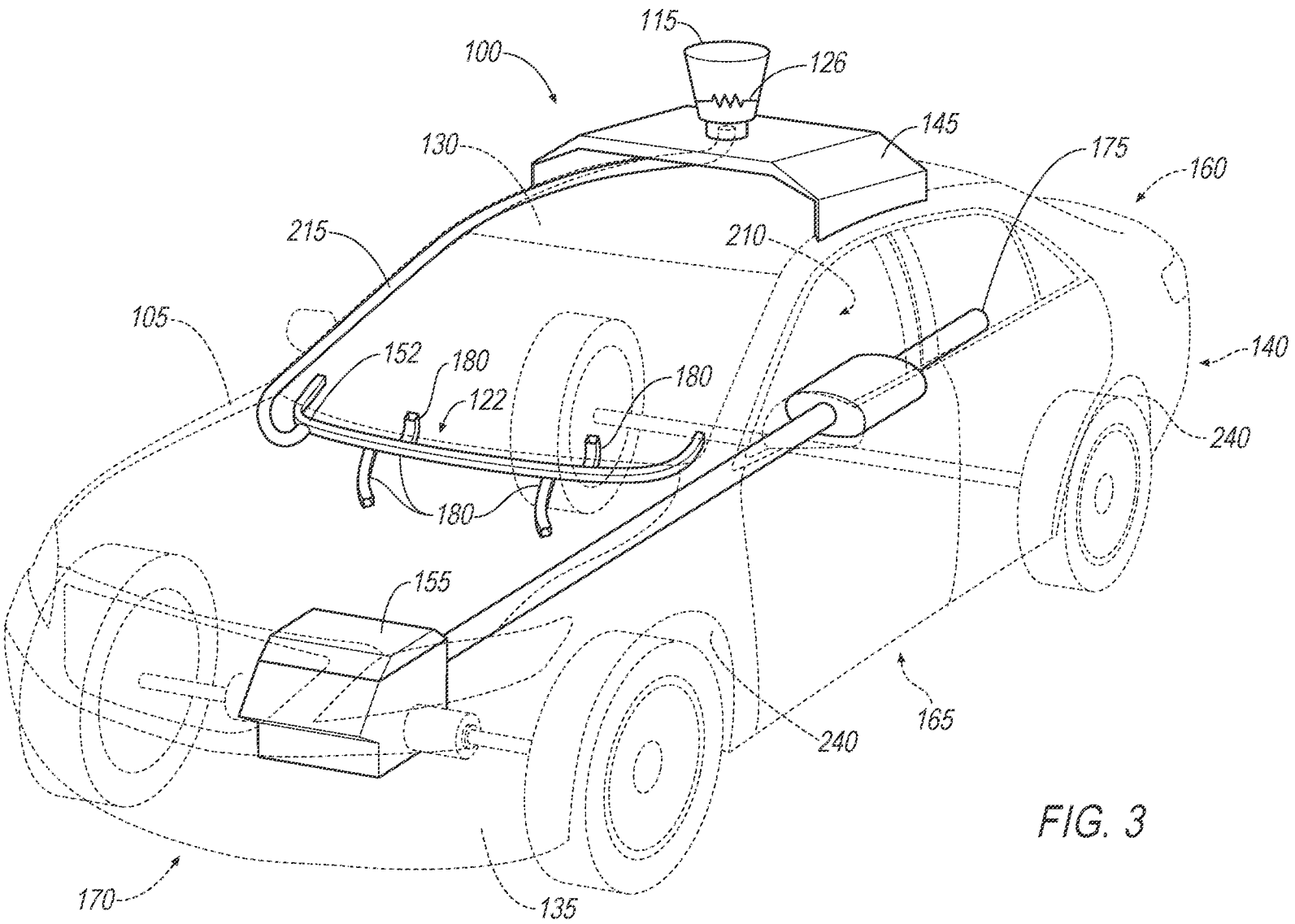
FIG. 3 is a perspective view of a host vehicle including a passenger cabin heating subsystem that diverts a heat byproduct to a vehicle sensor.
Figure 4:
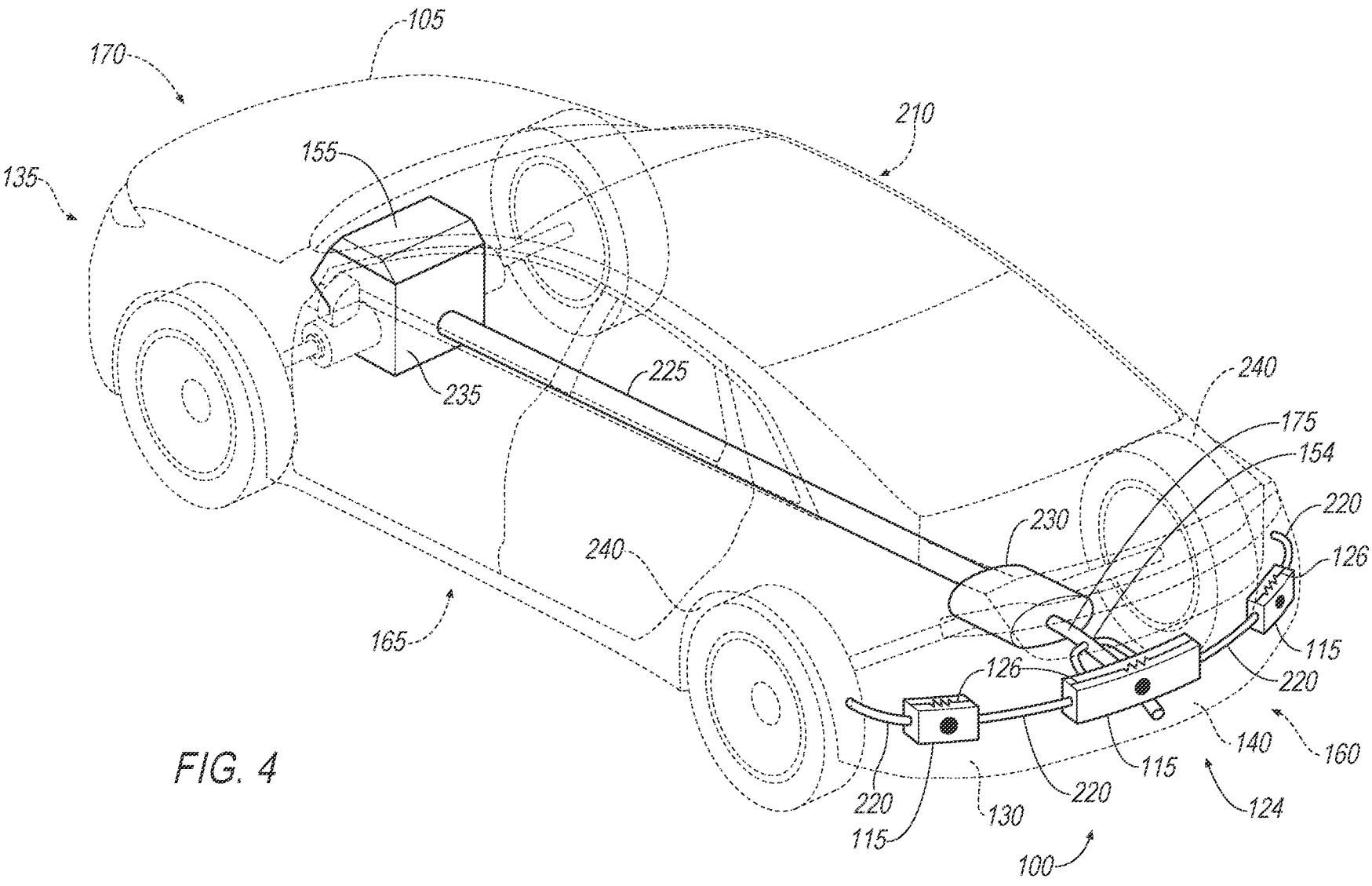
FIG. 4 is a perspective view of a host vehicle including an exhaust gas subsystem that diverts a heat byproduct to vehicle sensors.

The vehicle 105 heat sources may include one or more vehicle 105 subsystems, e.g., the engine cooling subsystem 120 (see FIG. 2), the passenger cabin heating subsystem 122 (see FIG. 3), and the engine exhaust gas subsystem 124 (see FIG. 4). These subsystems 120, 122, 124 are typically present in vehicles that use fossil fuels as energy sources, and each typical generates and/or emits heat. As described below, heat may be accessed and diverted from one or more sources to supply heat to the critical sensors 115. As demonstrated in FIGS. 2-4, a subsystem 120, 122, 124 closest to a sensor 115 at risk from cold conditions can minimize the hardware, e.g., tubing, ductwork, etc., needed to couple the subsystem 120, 122, 124 to the sensor 115. Therefore, a sensor 115 can be associated with a corresponding heat source subsystem 120, 122, 124, etc., that is closest to the sensor 115. When the computer 110 determines that a sensor 115 should be heated, as described above, heat from the subsystem 120, 122, 124 closest to the sensor 115 may be diverted and directed toward the sensor 115. The location of the subsystems 120, 124, 126 in the vehicle 105, as shown in FIGS. 2-4, is by way of example and not limitation. In other words, for example, the host vehicle 105 may have the engine 155 and the associated engine cooling subsystem 120 mounted in a rear portion 160 of the vehicle 105, and a tailpipe 175 of the engine exhaust gas subsystem 124 in a middle portion 165 of the vehicle 105.

Heat can be diverted from a subsystem 120, 122, 124 by a valve or the like, e.g., an engine coolant valve 150, a damper actuator 152, an exhaust gas valve 154, respectively. The computer 110 may output a control signal to actuate the valve 150, 152, 154 when heat is needed for a sensor 115. The duration for which the computer 110 diverts heat to a specific sensor 115 may be predefined and established empirically. Predefined heat duration values, e.g., for heating a specified sensor (or set of sensors) from a specified starting temperature for a specified duration, may be stored in the computer 110 memory. The computer 110 may be connected to a valve 150, 152, 154 via direct electrical wires, a communication bus, e.g., CAN, LIN, etc., or a wireless connection, e.g., Bluetooth, WiFi, etc. The valve 150, 152, 154 may be any suitable valve capable of diverting engine coolant, heated passenger cabin air, or high temperature exhaust gas, respectively.

As shown in FIG. 2, the engine cooling subsystem 120 is located, for example, in a front portion 170 of the host vehicle 105. The cooling subsystem 120 may include a radiator 185, an inlet 190 and an outlet 195 and coolant tubes 200. In an engine cooling subsystem 120, hot engine coolant can flow from the engine 155 into the radiator 185 via the inlet 190, through the coolant tubes 200 where heat is transferred out of the coolant. The cooler coolant then returns to the engine 155 via the outlet 195.

Further, as illustrated in FIG. 2, hot engine coolant from the engine coolant subsystem 120 may be diverted and used to heat the sensor 115. For example, auxiliary coolant lines 205 may be added to the radiator 185, and a coolant flow rate in the lines 205 can be controlled by the engine coolant valve 150. The auxiliary lines 205 may touch, and/or be routed to be sufficiently proximate to, the sensor 115 such that the radiated heat energy from the auxiliary lines 205 may warm the sensor 115, which in turn may prevent ice and/or snow formation and/or melt existing ice and/or snow on the one or more sensors 115 that may be mounted in the front portion 170 of the vehicle 105. The valve 150 along with the auxiliary lines 205 may branch off the engine coolant subsystem 120, bleed a portion of the hot coolant from the subsystem 120 while returning cooler coolant back to the subsystem 120. More specifically, the coolant temperature in the radiator 185 varies from the inlet 190 to the outlet 195, and the branch locations from the radiator 185 and/or the inlet 190 and outlet 195 may be empirically determined based on a target warming temperature for the one or more sensors 115 to be heated, as well as accessible branch locations within the subsystem 120.

The auxiliary coolant lines 205 form a closed heating loop starting from the radiator 185, to the auxiliary coolant lines 205, through the critical sensors 115, and back to the radiator 185. There may be one or more sensors 115 in the front portion 170 of the vehicle 105, e.g., three sensors 115 are shown in FIG. 2. The computer 110 via the control signal may fully open the engine coolant valve 150, or to control the coolant flow rate through the valve 150, e.g., by pulse width modulating the control signal with a varying duty cycle. The computer 110 may control the amount of heat delivered to the sensor 115 by controlling the flow rate of the engine coolant via the control signal.

Further, more than one engine coolant valve 150 may be used in the closed heating loop formed by the radiator 185 and lines 205. For example, valves 150 may be placed at either end of the auxiliary coolant line 205 closest to the radiator 185, and independently controlled with respective control signals from the computer 110. Bidirectional flow may be achieved with this configuration, i.e., the coolant flow in the auxiliary lines 205 may flow in either direction as determined by the computer 110 on/off sequencing of the valves 150 via the control signals.

As shown in FIG. 3, the passenger cabin heating subsystem 122 is located, for example, in the middle portion 165 of the host vehicle 105. The cabin heating subsystem 122 includes HVAC heating ducts 180 running throughout the passenger cabin 210. The damper actuator 152, which is a motorized device such as is known for regulating air flow through a heat duct, acts as an air diverter and is controlled by a control signal from the computer 110. The actuator 152 may divert warm air from the cabin heating subsystem 122 through an auxiliary heating duct 215 to an area proximate the one or more critical sensors 115 that may be mounted in the middle portion 165 of the host vehicle 105. The computer 110 via the control signal may fully open the damper actuator 152 to divert the maximum amount of hot air, or control a flow rate of the hot air by adjusting the actuator 152 to some intermediate position. The computer 110 may control the amount of heat delivered to the sensor 115 by controlling the flow rate of the hot cabin air via the control signal. The heat energy from the hot cabin air may transfer to the colder sensor 115, which in turn warms the sensor 115, and may prevent ice and/or snow formation or melt existing ice and/or snow.

The auxiliary heating duct 215 may operate as an open duct system. In this case, the sensor 115 may be warmed by diverted hot cabin air that flows over the sensor 115 from the duct 215 that openly vents the air sufficiently proximate to the sensor 115, as shown in FIG. 3. There may be one or more sensors 115 in the middle portion 165 of the vehicle 105, e.g., one sensor 115 is shown in FIG. 3. The auxiliary heating duct 215 may narrow at an end of the duct 215 causing an increase in hot air flow rate, which may be directed at portions of the sensor 115 that are more sensitive to cold conditions. Alternatively, the auxiliary duct 215 may form a closed air heating loop (not shown). The closed air heating loop would require two damper actuators 152 coupled to the HVAC ducts 180 with each actuator 152 independently controlled with respective control signals from the computer 110. The auxiliary heating duct 215 could run from one actuator 152, surround at least a portion of one or more sensors 115 and route back to the HVAC ducts 180 through the second actuator 152. The actuators 152 could be at different locations. Bidirectional air flow may be achieved with a closed air heating loop, i.e., the hot air flow in the auxiliary duct 215 may flow in either direction as determined by the computer 110 on/off sequencing of the actuators 152 via the control signals.

With reference to FIG. 4, the engine exhaust gas subsystem 124 is located, for example, in the rear portion 160 of the host vehicle 105. The exhaust gas subsystem 124 includes a downpipe 225, a catalytic converter 230 and the tailpipe 175. The downpipe 225 is connected to an engine manifold 235 on one end and directs the raw exhaust gas from the engine 155 to the catalytic converter 230. The catalytic converter 230 reduces the pollutants from the raw exhaust gas, and the filtered exhaust gas travels along the tailpipe 175 where it is vented to the environment.

Further, as illustrated in FIG. 4, hot exhaust from the engine exhaust gas subsystem 124 may be diverted and used to heat the sensor 115. For example, auxiliary exhaust pipes 220 may be connected to the tailpipe 175, and an exhaust gas flow rate in the pipes 220 can be controlled by the exhaust gas valve 154. The auxiliary pipes 220 may touch, and/or be routed to be sufficiently proximate to, the sensor 115 such that the radiated heat energy from the pipes 220 may warm the sensor 115, which in turn may prevent ice and/or snow formation and/or melt existing ice and/or snow on the one or more sensors 115 that may be mounted in the rear portion 160 of the vehicle 105. Alternatively or additionally, the sensor 115 may be warmed by hot exhaust gas flowing over the sensor 115 from auxiliary pipes 220 that openly vent sufficiently proximate to the sensor 115 to provide heat transfer. In this case, the pipes 220 may be fitted with a nozzle at an end of the pipes 220, which may be used to increase the exhaust gas flow rate, and control the direction and spread of the gas in order to more efficiently heat the sensor 115. The exhaust gas valve 154 along with the auxiliary pipes 220 may branch from the tailpipe 175 and divert a portion of the existing exhaust gas toward one or more sensors 115, e.g., three sensors 115 are shown in FIG. 4. A location at which the exhaust valve 154 branches from the tailpipe 175 may be empirically determined, e.g., in a manner as described above.

The computer 110 can provide a control signal to fully open the exhaust gas valve 154 to divert a maximum amount of exhaust gas, or control the exhaust gas flow rate by adjusting the gas valve 154 to an intermediate position, e.g., selected according to an amount of exhaust gas to be diverted based on a desired amount of heat. Alternatively, the computer 110 may control the exhaust gas flow rate through the exhaust valve 154 by, e.g., pulse width modulating the control signal with a varying duty cycle. The computer 110 may control the amount of heat delivered to the sensor 115 by controlling the flow rate of the exhaust gas via the control signal.

The auxiliary exhaust pipes 220 operate as an open system, i.e., the pipes 220 may terminate in a wheel well 240 of the vehicle 105. The auxiliary exhaust pipes 220 may terminate in any suitable location, e.g., under the rear bumper 140, under the vehicle 105, proximate to the sensor 115, etc. Depending on the number of critical sensors 115, there may be one or more auxiliary exhaust pipes 220 and/or exhaust valves 154. The exhaust valves 154 could be at multiple locations, and each valve 154 may by actuatable by an independent control signal with each signal controlled by the computer 110.

As illustrated in FIGS. 1-4, the vehicle 105 may include one or more resistive heating elements 126 There may be one or more resistive heating elements 126 per vehicle sensor 115. Alternatively or additionally, there may be one heating element 126 which heats two or more sensors 115. The purpose of the resistive heating element 126 is to supplement the diverted heat from heat sources 120, 122, 124 and/or provide a heat source to warm the sensor 115 when the engine 155 of the vehicle 105 is not running, i.e., when the heat source subsystems 120, 122, 124 are no longer producing appreciable heat. With respect to the latter case, for example, the computer 110 may be programmed, as discussed below, to actuate the heating element 126 at a predetermined time before the vehicle 105 engine 155 is started to warm one or more sensors 115, e.g., melt existing ice and/or snow from the sensor(s) 115. Yet further, the resistive heating elements 126 may be included on a host vehicle 105 lacking certain heating source subsystems, 120, 122, 124, e.g., battery electric vehicles (BEV) or the like.

The computer 110 may be programmed to output a control signal that actuates the resistive heating element 126. For example, the control signal may actuate a relay, a switch, etc., that connects the heating element 126 to a source of high current, e.g., a vehicle 105 battery or the like.

The resistive heating element 126 may be directly fixed to the sensor 115, e.g., molded, fastened, etc. Alternatively or additionally, the heat from the element 126 may be coupled to the sensor 115 indirectly via heating channels, e.g., a heating plate, heating tubes, etc., that diffuse the heat proximate to the sensor 115 when the element 126 is actuated. The resistive heating element 126 may be any suitable device that converts electricity into heat through the process of resistive, i.e., Joule, heating. The resistive heating element 126 may be formed of any suitable material, e.g., metal, ceramic, polymer, etc.

Exemplary Process Flow

Figure 5:
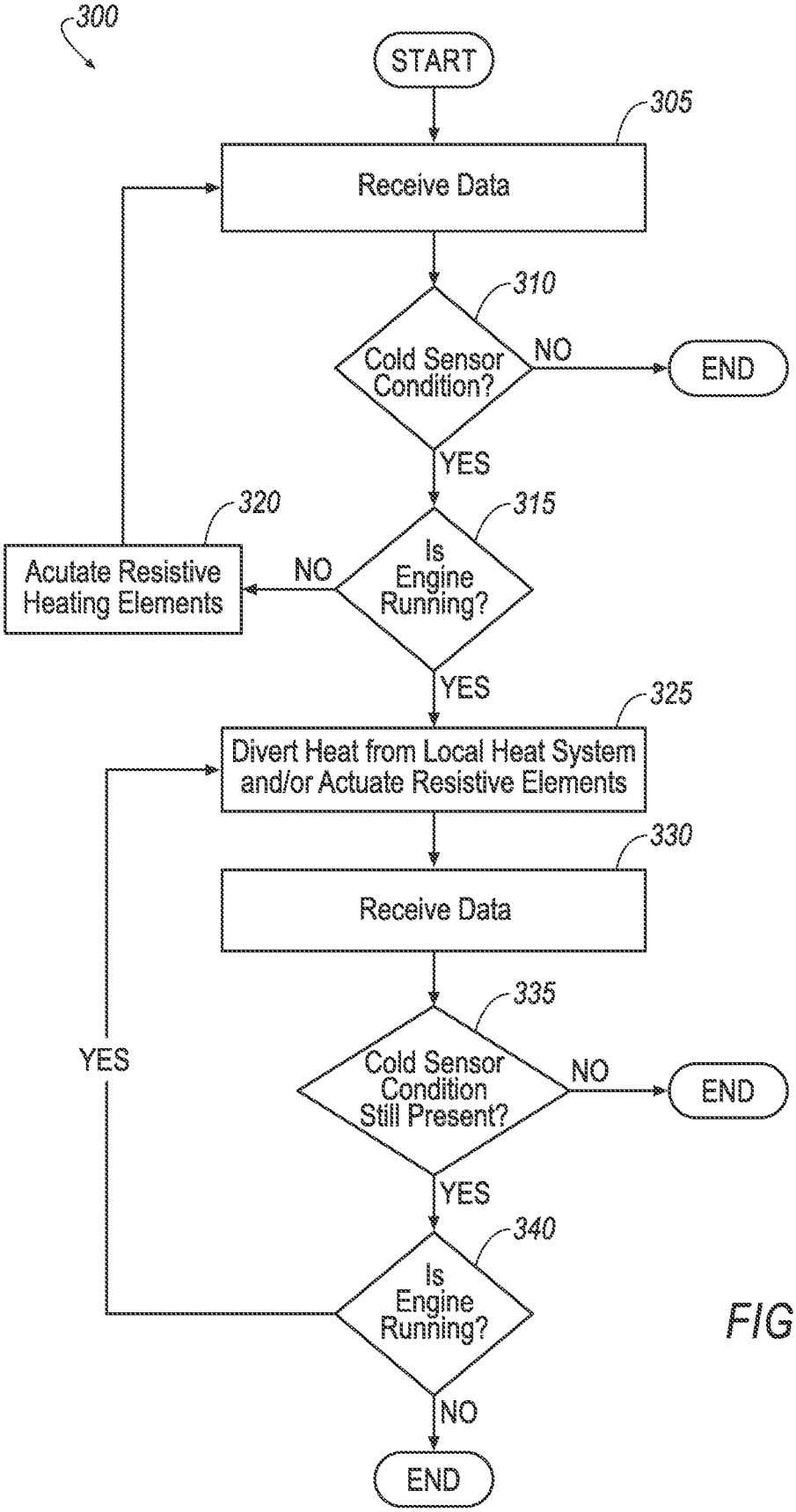
FIG. 5 is a flowchart of an example process for the vehicle sensor cold mitigation system of FIG. 1.

FIG. 5 is a flowchart of an exemplary process 300 for mitigating a vehicle 105 cold sensor 115 condition. The process 300 may be executed multiple times while the engine 155 of the host vehicle 105 is running so that the computer 110 can receive data from vehicle sensors 115 and other subsystems, as mentioned above, to determine whether a cold condition exists, e.g., potential icing, snow and/or extreme cold conditions are present, warranting cold mitigation actions. In some possible approaches, the process 300 may be executed at a predetermined time before the host vehicle 105 engine 155 is started to de-ice or otherwise warm sensors 115 when requested by a remote system, e.g., infotainment system, cell phone application, etc. In another possible approach, the process 300 may execute at vehicle 105 start-up so that e.g., the computer 110 may determine whether ice and/or snow has accumulated on the vehicle sensors 115 thus warranting de-icing and/or warming.

The process 300 begins in a block 305, in which the computer 110 receives data from the vehicle sensors 110. For example, the computer 110 may receive environmental measurements from one or more vehicle sensors 115, e.g., temperature, humidity, etc. Further, the computer 110 could receive data such as weather conditions and/or forecasts from a remote computer, location data from a GPS subsystem, etc., via wired and/or wireless connections, etc. The data received by the computer 110 is typically stored in the memory of the computer 110.

Next, in a decision block 310, the computer 110 determines whether a cold vehicle sensor 115 condition exists by analyzing the data received in the block 305. The computer 110 could determine that a cold condition generally exists with respect to all vehicle 105 sensors 115, vehicle 105 sensors 115 in a particular region (e.g., front or rear) of the vehicle 115, or for specified one or more sensors 115. For example, the computer 110 may determine, e.g., according to detected ambient temperature and humidity, a received weather report, etc., that environmental conditions are favorable for ice and/or snow formation on a sensor 115 and/or that extreme cold conditions exist and pose a danger to one or more sensors 115.

Alternatively or additionally, the computer 110 may determine that ice and/or snow have accumulated one or more sensors 115. For example, the computer 110 could identify a deterioration of sensor 115 performance due to ice and/or snow accumulation by comparing data received from multiple sensors 115, e.g., lidar, radar, camera, etc., to data received from a particular sensor 115 to a sensor 115 as impaired, e.g., to determine that the sensor 115 was providing data inconsistent with, e.g., outside of a predetermined range of, data values provided by similar sensors 115. As another example, the computer 110 could determine sensor 115 ice and/or snow accumulation, e.g., blockage, from sensor 115 data that is unchanging and persists over predetermined periods of time, e.g. 5 seconds, 10 seconds, etc., when driving conditions dictate a more rapid sensor 115 data change, e.g., less than 1 second. When the computer 110 determines that a cold sensor 115 condition exists with respect to a particular sensor 115, the computer 110 stores an indicator, e.g., a binary 1 or 0, of the cold condition in association with an identifier for the sensor 115. The process 300 proceeds to a block 315 if a cold condition is detected. Otherwise, the process 300 ends.

In a block 315 that follows the block 310, the computer 110 determines whether the vehicle 105 engine 155 is running. For example, the computer 110 may receive the status of the vehicle 105 engine run state via the CAN bus or the like from the e.g., powertrain control module (PCM), ECU, BCM, etc. If the engine 155 is not running, a heat byproduct from the vehicle 105 heating source subsystems 120, 122, 124 may not be available and the process proceeds to a block 320. Otherwise, the engine 155 is running, and the subsystems 120, 122, 124 may be available to supply the heat byproduct to warm the sensors 115, and the process 300 proceeds to a block 325.

In the block 320, the computer 110 identifies one or more resistive heating elements 126 associated to one or more sensors 115 according to data stored as described above. The computer 110 may then output one or more control signals to actuate one or more resistive heating elements 126 to provide heat to the identified sensor(s) 115. As described above, multiple heating elements 126 can be associated with a specific sensor 115, and/or multiple sensors 115 associated with a specific heating element 126.

In the block 325, which may follow one of the blocks 315, 340, the computer 110 identifies a heating source subsystem 120, 122, 124 that is associated to each sensor 115 identified with a cold condition by reading the stored memory values described above. The computer 110 may then output one or more control signals to actuate one or more valves or the like as described above, e.g., one or more of the engine coolant valve 150, the damper actuator 152, and the exhaust gas valve 154, respectively. As described above, each of the heating subsystems 120, 122, 124 may have more than one valve 150, 154 and/or actuator 152, and the computer 110 may actuate more than one of the valves 150, 154 and/or actuators 152 for heat byproduct diversion. The computer 110 may determine that supplemental heating is required for the sensors 115 exhibiting cold conditions, e.g., the heating source subsystems 120, 122, 124 are not producing sufficient heat in a period following an engine 155 start and/or the ambient temperature outside the vehicle 105 is extremely cold, etc. In this case, the computer 110 may output one or more control signals to actuate one or more resistive heating elements 126 depending on which element 126 is associated to the sensor 115 exhibiting a cold condition, as described above. The computer 110 may determine that supplemental heat from the elements 126 is no longer needed and deactivate elements 126 while maintaining diversion of heat from the heating subsystems 120, 122, 124.

Following the block 325, in a block 330, the computer 110 receives further data from the vehicle 105 sensors 115 and other subsystems, e.g., temperature, humidity, weather conditions, GPS location, etc. The data received by the computer 110 may be stored in the memory of the computer 110.

Next, in a decision block 335 the computer 110 determines according to data received in the block 325 whether a cold condition exists on a vehicle sensor 115, e.g., potential ice and/or snow formation, accumulation, extreme temperatures, etc. When the computer 110 determines that a cold sensor 115 condition exists on a particular sensor 115, the computer 110 may store an indicator as described above. If a cold condition exists, the process 300 proceeds to a block 340. Otherwise, the process 300 ends.

Next, in a block 340, the computer 110 determines whether the vehicle 105 engine 155 is still running. For example, the computer 110 may receive the status of the vehicle 105 engine run state via the CAN bus or the like from the e.g., PCM, ECU, BCM, etc. If the engine 155 is running, the process 300 proceeds to the block 325. Otherwise the process 300 ends.

With respect to the figures, the elements shown and described may take many different forms and can include multiple and/or alternate components. The example components illustrated are not intended to be limiting. Indeed, additional or alternative components and/or implementations may be used. Further, the elements shown are not necessarily drawn to scale unless explicitly stated as such.

As used herein, the adverb "substantially" modifying an adjective means that a shape, structure, measurement, value, calculation, etc. may deviate from an exact described geometry, distance, measurement, value, calculation, etc., because of imperfections in materials, machining, manufacturing, sensor measurements, computations, processing time, communications time, etc.

In general, the computing systems and/or devices described may employ any of a number of computer operating systems, including, but by no means limited to, versions and/or varieties of the Ford SYNC® application, AppLink/Smart Device Link middleware, the MICROSOFT® Automotive operating system, the Microsoft WINDOWS® operating system, the Unix operating system (e.g., the SOLARIS® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract is provided to allow the reader to quickly ascertain the nature of the technical disclosure. It is submitted with the understanding that it will not be used to interpret or limit the scope or meaning of the claims.

The invention claimed is:

1. A vehicle system, comprising a computer that includes a processor and a memory, wherein the computer is programmed to:

determine a cold condition of a vehicle sensor;

identify a vehicle subsystem from a plurality of available subsystems that each provide a heat byproduct during operation based on data specifying the vehicle subsystem as a heat source for the vehicle sensor for which the cold condition is determined; and divert at least some of the heat byproduct from the identified subsystem to the vehicle sensor.

2. The system of claim 1, wherein the selected vehicle subsystem is one or more of a vehicle engine coolant subsystem, a passenger cabin heating subsystem, and an exhaust gas subsystem.

3. The system of claim 1, wherein the cold condition is that ice has formed on an exterior surface of the vehicle.

4. The system of claim 1, wherein the cold condition is that ice has formed on the vehicle sensor.

5. The system of claim 1, wherein the computer is further programmed to make the determination at a specified time.

6. The system of claim 1, wherein the vehicle sensor is associated to a resistive heating element, the resistive heating element providing heat to the vehicle sensor.

7. The system of claim 6, wherein the resistive heating element is configured to be activated when a vehicle engine is off.

8. The system of claim 1, wherein the cold condition is a prediction of icing.

9. The system of claim 1, wherein the heat source is selected based on a proximity to the vehicle sensor.

10. The system of claim 1, wherein the computer is further programmed to control a heat flow and a heat flow direction of the heat byproduct.

11. A method comprising:

determining a cold condition of a vehicle sensor;

identifying a vehicle subsystem from a plurality of available subsystems and that each provide a heat byproduct during operation based on data specifying the vehicle subsystem as a heat source for the vehicle sensor for which the cold condition is determined; and diverting at least some of the heat byproduct from the identified subsystem to the vehicle sensor.

12. The method of claim 11, wherein the selected vehicle subsystem is one or more of a vehicle engine coolant subsystem, a passenger cabin heating subsystem, and an exhaust gas subsystem.

13. The method of claim 11, wherein the cold condition is that ice has formed on an exterior surface of the vehicle.

14. The method of claim 11, wherein the cold condition is that ice has formed on the vehicle sensor.

15. The method of claim 11, further comprising making the determination at a specified time.

16. The method of claim 11, wherein the vehicle sensor is associated to a resistive heating element, the resistive heating element providing heat to the vehicle sensor.

17. The method of claim 16, wherein the resistive heating element is configured to be activated when a vehicle engine is off.

18. The method of claim 11, wherein the cold condition is a prediction of icing.

19. The method of claim 11, wherein the heat source is selected based on a proximity to the vehicle sensor.

20. The method of claim 11, further comprising controlling a heat flow and a heat flow direction of the heat byproduct.

* * * * *